United States Patent [19]

Igarashi et al.

[11] Patent Number: 4,575,171

[45] Date of Patent: Mar. 11, 1986

[54] CONNECTOR CONNECTABLE AND DISCONNECTABLE WITHOUT FORCE

[75] Inventors: Yoshiaki Igarashi, Mooka; Shoichi Hamano, Yuki, both of Japan

[73] Assignee: Daiichi Denshi Kogyo Kabushiki Kaisha, Tokyo, Japan

[21] Appl. No.: 661,170

[22] Filed: Oct. 15, 1984

[30] Foreign Application Priority Data

Oct. 24, 1983 [JP] Japan ..... 58-164169[U]

[51] Int. Cl.[4] ..... H01R 13/629

[52] U.S. Cl. ..... 339/74 R; 339/75 MP

[58] Field of Search ..... 339/74 R, 75 MP

[56] References Cited

U.S. PATENT DOCUMENTS

| | | | |
|---|---|---|---|
| 3,793,609 | 2/1974 | McIver | 339/74 R |
| 4,179,177 | 12/1979 | Lapraik | 339/74 R |
| 4,392,705 | 7/1983 | Andrews, Jr. et al. | 339/75 MP |
| 4,470,653 | 9/1984 | Coller et al. | 339/74 R |

*Primary Examiner*—John McQuade

*Attorney, Agent, or Firm*—Silverman, Cass & Singer, Ltd.

[57] ABSTRACT

A connector connectable and disconnectable without requiring any force comprises a pivotal lever, a slide plate linearly movable in its longitudinal directions by the operation of the lever and adapted be raised and lowered in response to the linear movements, and an ON-OFF plate adapted to rise and lower in response to the rising and lowering movements of the slide plate for opening at least one pair of contacts by inserting the ON-OFF plate between the contacts in the rising movement of the ON-OFF plate and closing the pair of contacts by removing the ON-OFF plate from between the contacts in the lowering movement of the ON-OFF plate. According to the invention, the lever is made detachable from the connector to avoid the need of bulky boxes for packaging due to its elongated lever and risk of damage to the lever subjected to excess forces.

9 Claims, 11 Drawing Figures

CONNECTOR CONNECTABLE AND DISCONNECTABLE WITHOUT FORCE

BACKGROUND OF THE INVENTION

1. Field of the Invention

This invention relates to a connector connectable and disconnectable without requiring force, which is small-sized and easy in operation.

2. Description of the Prior Art

In electronic devices using a number of printed circuit boards, such as computers, parts of the printed circuit boards have been used as male contacts adapted to be inserted into multiple connectors to connect them with other circuits. In this case, however, the multiple connectors in general require great forces in inserting and removing the printed circuit boards. Particularly, when many printed circuit boards are arranged side by side with small intervals, they make it difficult to apply force and hence insertion and removal of the circuit boards are difficult.

In order to avoid such difficulties, the inventors of this application had proposed a connector connectable and disconnectable with little force, so called "ZIF connector" as shown in FIGS. 1*a* and 1*b* connected to a printed circuit board and in FIGS. 2*a* and 2*b* disconnected from the printed circuit board.

With this connector, a lever having a lower end engaging with one end of an insulating casing 1 at 1*a* is pivotally connected at a mid portion to an extension 2*a* of a slide plate 2 at 3*a*. When an upper end of the lever is moved or swung to the right from a position in FIG. 1*a* to that in FIG. 2*a*, the slide plate 2 is moved to the right so as to cause OFF-projections 2*b* provided at a lower end of the slide plate to ride over lifting protrusions 1*b* of the insulating casing 1, so that the slide plate 2 is raised with the aid of a camming action of the OFF-projections and the lifting protrusions as cam means. On the other hand, an ON-OFF plate 4 is supported by the slide plate 2, with a T-shaped support projection 4*a* of the ON-OFF plate 4 slidably fitted in an inverted T-shaped support groove 2*c* formed in an upper end of the slide plate over its full length. When the slide plate 2 is raised in the above manner, the ON-OFF plate 4 located on the slide plate 2 is simultaneously raised while being guided by a right-hand wall surface 1*c* preventing the ON-OFF plate 4 from moving together with the horizontal movement of the slide plate 2, to insert the ON-OFF plate 4 between a pair of contacts 5 as shown in FIG. 2*b*.

When the lever 3 is returned to the left viewed in FIG. 1*a*, the slide plate 2 is returned to its original position and the ON-OFF plate 4 is lowered guided by a left-hand wall surface 1*d* of the insulating casing 1 together with the slide plate 2 lowering downward and moving to the left, thereby removing the ON-OFF plate 4 from the pair of the contacts 5.

With this arrangement, after the ON-OFF plate 4 has assumed between the contacts 5 to keep the female contacts to be opened as shown in FIG. 2*b*, a printed circuit board 6 is inserted into a V-shaped recess or groove 4*b* of the ON-OFF plate 4 through an insert aperture 1*e* and then the ON-OFF plate is removed from the pair of contacts 5 to bring the female contacts into contact with the printed circuit board 6, thereby completing the connection of the connector without requiring any force for inserting the printed circuit board 6 as shown in FIG. 1*b*. In order to remove the printed circuit board already inserted, the ON-OFF plate is inserted between the pair of contacts 5 to enable the printed circuit board 6 to be removed without requiring any force in the same manner as the above.

Moreover, the raising and lowering of the ON-OFF plate 4 caused by the slide plate 2 is effected by the operation of the lever 3. As a length $l_2$ from the pivot point 3*a* to the top of the lever 3 is made much longer than a length $l_1$ from the pivot point 3*a* to the lower end of the lever, the lever can be operated only with a small force even if contact pressures resulting from the resilience of the pair of contacts 5 are high enough. Furthermore, the slide plate 2 and the ON-OFF plate 4 undergo only linear vertical and horizontal movements which are very simple movements sufficient to avoid any trouble. In a prior art, for example, a connector connectable and disconnectable without force as shown in FIGS. 3*a*, 3*b* and 3*c*, a flat cam plate 8 is rotated by rotating a handle 7 provided at one end of the cam plate to open pairs of contacts 5 away from each other. The flat cam plate is torsionally deformed so that the end of the flat cam plate remote from the handle 7 rotates only an angular displacement smaller than that of the handle 7, with the result that the pairs of contacts remote from the handle open only insufficient amounts, and the cam plate 8 is often fractured upon being subjected to an excess force. Such troubles are not the case in this connector which the inventors had proposed.

On the other hand, however, with the connector having the lever 3 for operating the slide plate 2 as shown in FIGS. 1 and 2, the lever 3 is unavoidably made long in order to operate it with a small force, in the event of a large number of contacts of the connectors or multiple connectors.

There is often a case that a number of printed circuit boards 6 are arranged one upon the other spaced only with small clearance in order to provide a small-sized connector as shown in FIG. 4. In this case, even if an elongated lever is not needed in consideration of the operating force, ends of short levers 3 are located between the printed circuit boards 6*a* and 6*b*, so that they are difficult to operate. It is therefore in this case needed to elongate the levers out of the printed circuit boards 6*a* and 6*b* as shown in broken lines in FIG. 4. As the result, the connectors having elongated levers extending beyond edges of the printed circuit boards are bulky and require larger packaging boxes for packaging. In packaging these connectors in boxes or incorporating them in electronic devices, moreover, these levers are likely to be subjected to excess forces resulting in fractures of the levers.

SUMMARY OF THE INVENTION

It is a primary object of the invention to provide an improved connector connectable and disconnectable without requiring any force including a lever and an ON-OFF plate adapted to move vertically by the lever, which completely eliminates all the disadvantages in the prior art such as the need of bulky boxes for packaging due to its long lever and risk of damage to the lever subjected to excess forces.

These objects are accomplished by the connector according to the invention connectable and disconnectable without requiring any force including an insulating casing, a lever operable out of said insulating casing, a slide plate linearly movable in its longitudinal directions by operation of said lever, cam means causing said slide plate to rise and lower in response to its linear longitudinal movements, and an ON-OFF plate movable vertically in response to the rising and lowering movements of the slide plate for opening at least one pair of contacts by inserting said ON-OFF plate between said contacts in the rising movement of said ON-OFF plate and closing said pair of contacts by removing said ON-OFF plate from between the contacts in the lowering movement of said ON-OFF plate, wherein said lever is made detachable from the connector.

In a preferred embodiment of the invention, the slide plate is formed in its one end with a guide hole opening at its upper and lower ends so as to permit the lever to insert into the guide hole, at least one sidewall of the guide hole being formed with a lever support aperture opening at its upper end, and the lever is provided on its at least one surface with a support pin such that the lever is pivotally supported by the slide plate by supporting the support pin in the lever support aperture with the lower end located in an engaging aperture formed in the insulating casing, thereby enabling the lever to be detachable.

The lever support aperture preferably comprises in its upper portion a guide slit having at its uppermost portion a width larger than a diameter of the support pin and at its lowermost portion a width slightly smaller than the diameter of the support pin to form a narrowed portion, and in the lower portion a circular support aperture merging with the guide slit and having a diameter not smaller than the diameter of the support pin, thereby enabling the support pin to be in snap engagement in the circular support aperture through the narrowed portion.

In order that the invention may be more clearly understood, preferred embodiments will be described, by way of example, with reference to the accompanying drawings.

BRIEF DESCRIPTION OF THE DRAWINGS

FIG. 5*b* is a partial sectional view of the connector shown in FIG. 5*a.

DETAILED DESCRIPTION OF THE PREFERRED EMBODIMENT

Figure 1A:
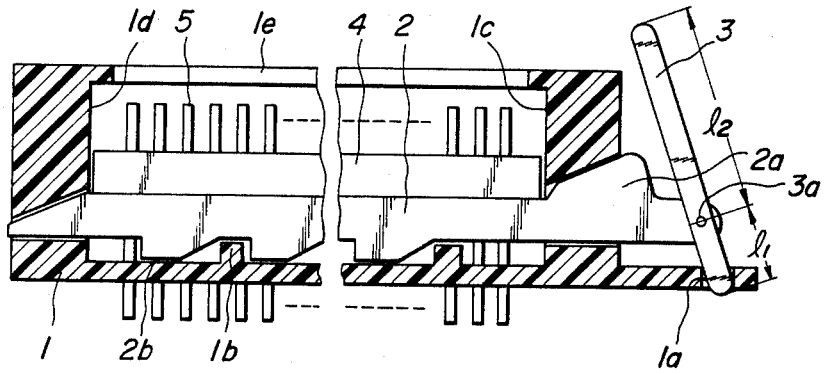
FIG. 1a PRIOR ART
FIG. 1*a* is a sectional front elevation of a connector of the prior art.
Figure 1B:
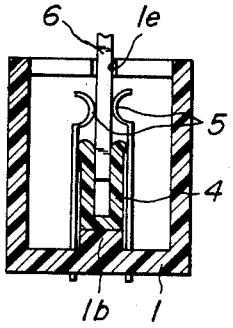
FIG. 1b PRIOR ART
FIG. 1*b* is a sectional side view of the connector shown in FIG. 1*a* connected with a printed circuit board.
Figure 2A:
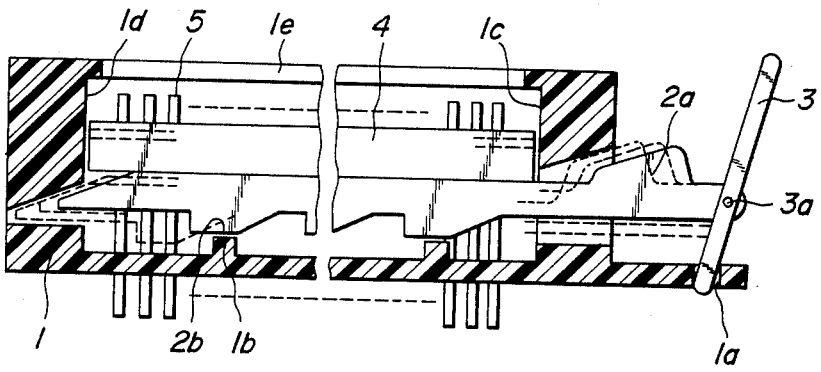
FIG 2a PRIOR ART
FIG. 2*a* is a sectional front elevation of the connector shown in FIG. 1*a* illustrating an ON-OFF plate in disconnecting position.
Figure 2B:
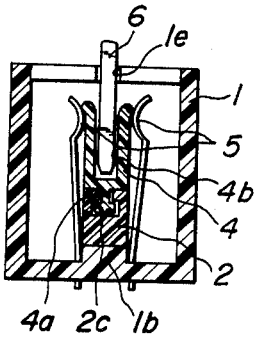
FIG 2b PRIOR ART
FIG. 2*b* is a sectional side view of the connector shown in FIG. 1*a* disconnected from the printed circuit board by the ON-OFF plate.
Figure 3A:
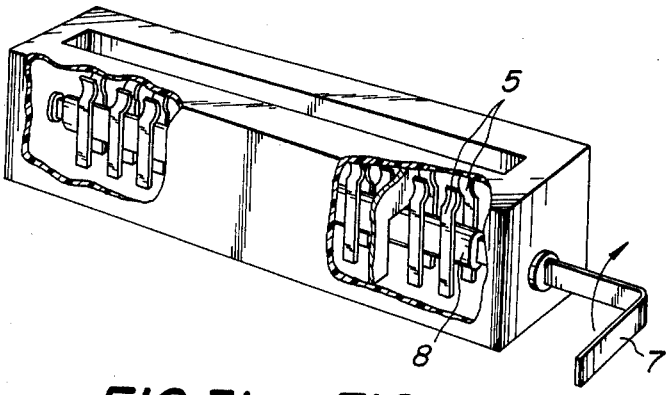
FIG 3a PRIOR ART
FIGS. 3*a*, 3*b* and 3*c* are perspective and sectional side views of another connector of the prior art, respectively.
Figure 3B:
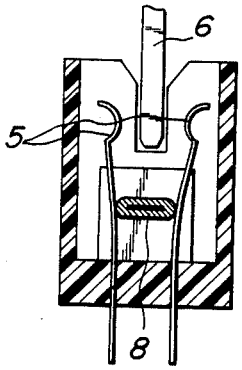
FIG 3b PRIOR ART
Figure 3C:
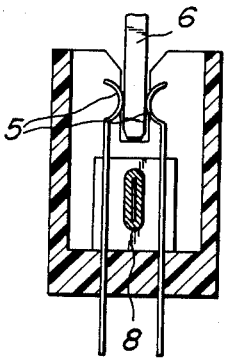
FIG 3c PRIOR ART
Figure 4:
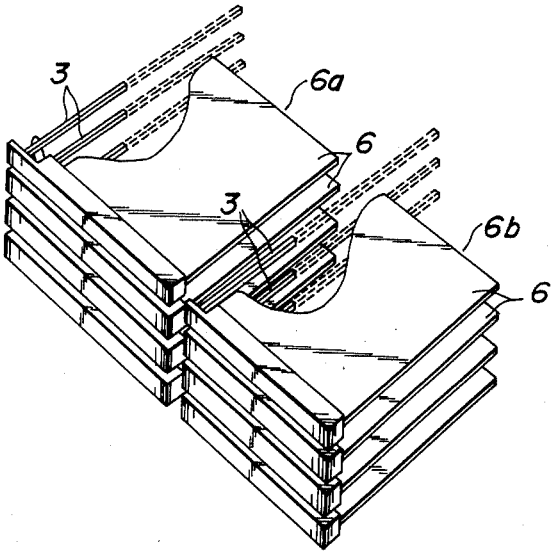
FIG 4 PRIOR ART
FIG. 4 is a perspective view illustrating a number of printed circuit boards juxtaposed using connectors of the prior art.
Figure 5A:
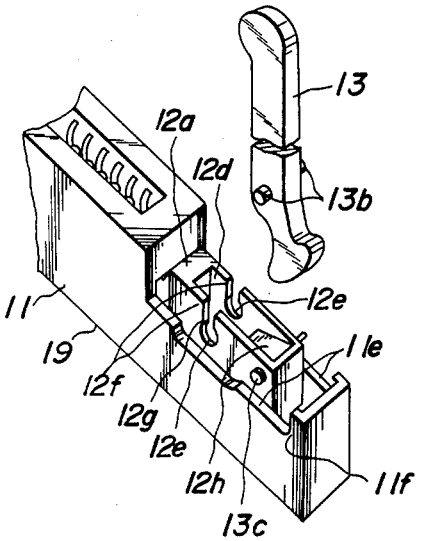
FIG. 5*a* is a perspective view of one embodiment of the connector according to the invention.
Figure 5B:
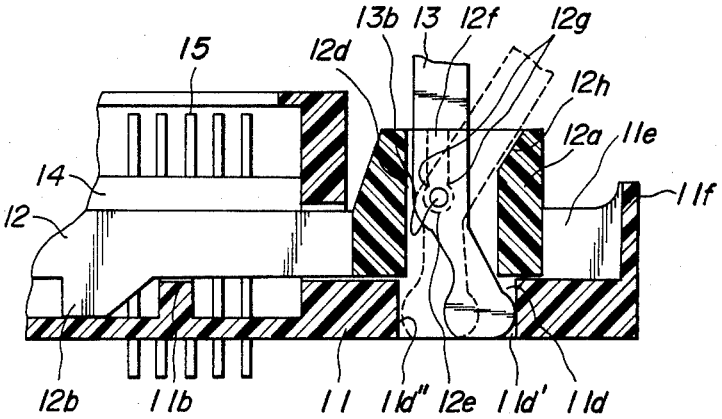

Referring to FIGS. 5*a* and 5*b*, the connector according to the invention comprises a lever 13 adapted to be detachable from the connector, so that the connector does not have the lever under its normal operating condition, and the lever is attached to the connector only when it is connected or disconnected. Such a feature is quite different from connectors of the prior art. A slide plate 12 comprises a raised portion 12*a* formed with a guide hole 12*d* vertically passing therethrough and formed in sidewalls of the guide hole 12*d* with support apertures 12*e* opening at upper surfaces of the sidewalls. The lever 13 is provided with a support pin 13*b* and is inserted in the guide hole 12*d* in a manner to fit the support pin 13*b* in the bottoms of the support apertures 12*e* and to locate a lower end of the lever 13 in an engagement aperture 11*d* formed in a bottom of an insulating casing 11 near its one end, thereby pivotally mounting the lever 13 onto the connector 19.

As shown in FIGS. 5*a* and 5*b*, the insulating casing 11 comprises guide walls 11*e* for guiding the slide plate 12 and stoppers 11*f* for determining an extreme position of the slide plate 12. On the other hand, the slide plate 12 is provided with position control protrusions 13*c* adapted to abut against the stoppers 11*f* of the casing to limit excess movement of the slide plate to the right viewed in FIG. 5*b*. Such a limitation of the movement of the slide plate is also effected by an engagement of the lower end of the lever 13 with a left wall surface of the engagement aperture 11*d*. Accordingly, the position control protrusions 13*c* of the slide plate 13 and the stoppers 11*f* of the insulating casing 11 may be dispensed with. Moreover, as the slide plate 12 is guided in its longitudinal movements supported by the ends of the insulating casing 11, the guide walls 11*e* may be omitted as well.

Guide slits 12*f* formed in the sidewalls of the guide hole 12*d* for guiding the support pin 13*b* are larger in width than a diameter of the support pin 13*b* of the lever 13 but tapered or converged downwardly to narrowed portions 12*g* having a width slightly smaller than the diameter of the support pin 13*b*. The narrowed portions 12*g* merge into the circular support apertures 12*e* having a diameter slightly larger than the diameter of the support pin 13*b*. When the lever is inserted into the guide hole 12*d*, the support pin 13*b* is forced through the narrowed portions 12*g* into snap engagement in the support apertures 12*e*. A user knows the settlement of the lever in position prevented from jumping up by the feeling of the snap engagement.

In fact, however, the support pin 13*b* is prevented from rising out of the support apertures 12*e* by the fact that the lower end of the lever 13 is urged against the left wall surface 11*d'* or right wall surface 11*d''*, and the support pin 13*b* of the lever 13 is subjected to forces in longitudinal directions of the slide plate 12. The narrowed portions 12*g* may be therefore omitted in the event that a large operating force is not needed because of less number of contacts and settlement of the lever 3 in the connector can readily be confirmed.

A reference numeral 12*h* denotes an oblique surface for keeping the lever 13, which is formed by chamfering an edge of the guide hole 12*d* and serves to substantially elongate the guide hole 12*d* and to prevent the lever from being damaged by the edge. In this embodiment, the lever 13 is bent at the proximity of the support pin 13*b* to form an obtuse angle.

The connector constructed as above described according to the invention eliminates the trouble in the prior art requiring bulky boxes for packaging due to levers and risk of damage to the levers subjected to excess forces when packaging them or incorporating them in devices. Therefore, the connector according to the invention enables its lever to be elongated without any restriction depending upon its requirement. In case of a number of printed circuit board juxtaposed, there is no interference with the operation due to superimposed ends of the levers in alignment with each other as in the prior art connector having a lever which cannot be detached from the connector. Moreover, according to the invention the lever can be made thick enough to obtain a sufficiently high strength, so that the lever is not damaged even if it is long enough to make it possible to operate the connector certainly with a small force.

Figure 6:
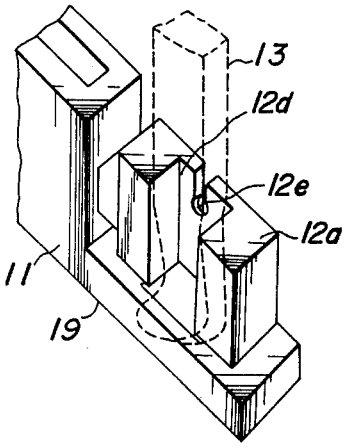
* and FIG. 6 is a partial perspective view of a modification of the connector according to the invention.

In another embodiment of the invention shown in FIG. 6, a support pin 13*b* provided on one face of a lever 13 may be fitted in a support aperture 12*e* formed in a guide hole 12*d* in the form of a groove in case of a small number of contacts which require only a small operating force.

Although the above embodiments have been explained with the printed circuit boards to be connected or disconnected without requiring force, the invention can of course be applicable to usual male connectors connectable and disconnectable without requiring force.

As can be seen from the above explanation, according to the invention a lever is adapted to fit in the connector only when the connector is connected or disconnected, thereby eliminating the trouble requiring bulky boxes for packaging due to its elongated lever and the risk of damage of the lever subjected to excess forces. Therefore, the connector according to the invention can be small-sized and enables its lever to be elongated sufficiently to operate the connector securely only with a small force. These advantages are effective in practical use of the connector.

It is further understood by those skilled in the art that the foregoing description is that of preferred embodiments of the disclosed connectors and that various changes and modifications may be made in the invention without departing from the spirit and scope thereof.

What is claimed is:

1. In a connector connectable and disconnectable without requiring any force including an insulating casing, a lever operable out of said insulating casing, a slide plate linearly movable in longitudinal directions by operation of said lever, cam means causing said slide plate to rise and lower in response to linear longitudinal movements thereof, and an ON-OFF plate movable vertically in response to the rising and lowering movements of the slide plate, at least one pair of contacts being opened by inserting said ON-OFF plate between said contacts in the rising movement of said ON-OFF plate, said pair of contacts being closed by removing said ON-OFF plate from between the contacts in the lowering movement of said ON-OFF plate, the improvement comprising said lever being made detachable from the connector, wherein said slide plate includes at least one sidewall having a guide hole formed contiguous with said sidewall at one end of said slide plate, said guide hole opening through said slide plate at respective upper and lower edges of said sidewall to enable insertion of said lever through said guide hole so that a lower end of said lever projects below the lower edge of said sidewall into an engaging aperture formed in said insulating casing, said sidewall having a lever support aperture extending through said upper edge, said lever having at least one surface thereof provided with a projecting support pin inserted into said lever support aperture through said upper edge for enabling said lever to be detachable and for enabling pivot of said lever about said pin supported on said slide plate.

2. A connector as set forth in claim 1, wherein said lever support aperture comprises in its upper portion a guide slit having at its uppermost portion a width larger than a diameter of said support pin and at its lowermost portion a width slightly smaller than the diameter of said support pin to form a narrowed portion, said lever support aperture further comprising a lower, circular portion merging with said guide slit and having a diameter not smaller than the diameter of said support pin, thereby enabling said support pin to be in snap engagement in said circular portion through said narrowed portion.

3. A connector as set force in claim 2, wherein said guide slit is tapered downwardly to said narrowed portion.

4. A connector as set forth in claim 1, wherein a second said sidewall contiguous with said guide hole is formed with said respective lever support aperture and said lever is provided on a second surface with a second support pin inserted into said respective lever support aperture.

5. A connector as set forth in claim 1, wherein said insulating casing comprises guide walls for guiding said slide plate.

6. A connector as set forth in claim 1, wherein said insulating casing is provided with at least one stopper and said slide plate is provided with at least one position control protrusion which abuts against said stopper to limit excess movement of the slide plate.

7. A connector as set forth in claim 1, wherein said lever is bent at the proximity of said support pin to form an obtuse angle and an edge of said guide hole is chamferred to prevent said lever from being damaged by the edge of said guide hole.

8. A connector as set forth in claim 1, wherein said guide hole is formed as a groove in said sidewall.

9. A connector as set forth in claim 1, wherein said cam means comprises at least one OFF-projection provided on a lower end of said slide plate and at least one lifting protrusion in said insulating casing, said OFF-projection and said lifting protrusion cooperating with each other in a manner to raise said slide plate in its movement in the one longitudinal direction and to lower said slide plate in its movement in the other longitudinal direction by camming action of said OFF-projection and said lifting protrusion.

* * * * *